US011056063B2

(12) United States Patent
Wu et al.

(10) Patent No.: US 11,056,063 B2
(45) Date of Patent: Jul. 6, 2021

(54) PIXEL CIRCUIT AND DRIVING METHOD THEREFOR, AND DISPLAY DEVICE

(71) Applicants: Chongqing BOE Optoelectronics Technology Co., Ltd., Chongqing (CN); BOE TECHNOLOGY GROUP CO., LTD., Beijing (CN)

(72) Inventors: Zhongshan Wu, Beijing (CN); Xun Pu, Beijing (CN); Xin Bi, Beijing (CN); Jiandong Guo, Beijing (CN); Junhui Wu, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/609,278

(22) PCT Filed: Mar. 26, 2019

(86) PCT No.: PCT/CN2019/079714
§ 371 (c)(1),
(2) Date: Oct. 29, 2019

(87) PCT Pub. No.: WO2019/184916
PCT Pub. Date: Oct. 3, 2019

(65) Prior Publication Data

US 2020/0051511 A1 Feb. 13, 2020

(30) Foreign Application Priority Data

Mar. 28, 2018 (CN) ..... 201810264933.X

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0866* (2013.01); *G09G 2320/0233* (2013.01)

(58) Field of Classification Search
CPC ... G09G 2300/0819; G09G 2300/0842; G09G 2300/0861; G09G 2300/0866;
(Continued)

(56) References Cited

U.S. PATENT DOCUMENTS

2013/0002633 A1 1/2013 Chung
2013/0175941 A1 7/2013 Wu et al.
(Continued)

FOREIGN PATENT DOCUMENTS

CN 101192374 A 6/2008
CN 102651194 A 8/2012
(Continued)

OTHER PUBLICATIONS

International Search Report and Written Opinion issued in corresponding International Patent Application No. PCT/CN2019/079714, dated Jun. 27, 2019, with English translation.
(Continued)

*Primary Examiner* — Temesghen Ghebretinsae
*Assistant Examiner* — Sosina Abebe
(74) *Attorney, Agent, or Firm* — McDermott Will and Emery LLP

(57) ABSTRACT

A pixel circuit includes a data writing and compensation sub-circuit, a driving sub-circuit, and a light-emitting control sub-circuit. The data writing and compensation sub-circuit is configured to transmit a data signal from a data voltage terminal to the driving sub-circuit under control of a first
(Continued)

control signal terminal, and to compensate a threshold voltage of the driving sub-circuit under the control of the first control signal terminal. The light-emitting control sub-circuit is configured to transmit a first voltage signal from a first voltage terminal to the driving sub-circuit and the data writing and compensation sub-circuit under control of a second control signal terminal, and to transmit a second voltage signal from the second voltage terminal to the driving sub-circuit under the control of the second control signal terminal. The driving sub-circuit is configured to transmit a signal output from the light-emitting control sub-circuit to a light-emitting sub-circuit.

15 Claims, 7 Drawing Sheets

(58) Field of Classification Search
CPC ... G09G 2320/0233; G09G 2320/0238; G09G 3/3233; G09G 3/3258; G09G 3/3291
See application file for complete search history.

(56) References Cited

U.S. PATENT DOCUMENTS

| | | | | |
|---|---|---|---|---|
| 2016/0253014 | A1 | 9/2016 | Yang | |
| 2016/0260380 | A1 | 9/2016 | Yang | |
| 2017/0193904 | A1 | 7/2017 | Xu et al. | |
| 2017/0301290 | A1* | 10/2017 | Qing | G09G 3/3233 |
| 2020/0051511 | A1 | 2/2020 | Wu et al. | |

FOREIGN PATENT DOCUMENTS

| | | | | |
|---|---|---|---|---|
| CN | 104103239 | A | | 10/2014 |
| CN | 104167168 | A | | 11/2014 |
| CN | 104252844 | A | | 12/2014 |
| CN | 104766566 | A | * | 7/2015 |
| CN | 104766566 | A | | 7/2015 |
| CN | 104867456 | A | | 8/2015 |
| CN | 105070250 | A | | 11/2015 |
| CN | 108399894 | A | | 8/2018 |

OTHER PUBLICATIONS

Lee, Jae-Hoon et al, "A New a-Si:H TFT Pixel Circuit Compensating the Threshold Voltage Shift of a-Si:H TFT and OLED for Active Matrix OLED," IEEE Electron Device Letters, vol. 26, No. 12, Dec. 2005, pp. 897-899.

First Office Action issued in corresponding Chinese Patent Application No. 201810264933.X, dated Jun. 25, 2019, with English translation.

Second Office Action issued in corresponding Chinese Patent Application No. 201810264933.X, dated Dec. 25, 2019, with English translation.

Third Office Action issued in corresponding Chinese Patent Application No. 201810264933.X, dated Apr. 2, 2020, with English translation.

* cited by examiner

PIXEL CIRCUIT AND DRIVING METHOD THEREFOR, AND DISPLAY DEVICE

CROSS-REFERENCE TO RELATED APPLICATIONS

This application is a national phase entry under 35 USC 371 of International Patent Application No. PCT/CN2019/079714 filed on Mar. 26, 2019, which claims priority to Chinese Patent Application No. 201810264933.X, filed with the Chinese Patent Office on Mar. 28, 2018, titled "PIXEL CIRCUIT AND DRIVING METHOD THEREOF, AND DISPLAY DEVICE", which are incorporated herein by reference in their entirety.

TECHNICAL FIELD

The present disclosure relates to the field of display technologies, and in particular, to a pixel circuit and a driving method thereof, and a display device.

BACKGROUND

An organic light-emitting diode (OLED) display is a hotspot in the display field at present. Compared with a liquid crystal display (LCD), the OLED display has advantages such as a low power consumption, self-emission, a wide viewing angle and a fast response speed. A design of a pixel circuit is a core technology of the OLED display, which has important research significance.

SUMMARY

In one aspect, a pixel circuit is provided. The pixel circuit includes: a data writing and compensation sub-circuit, a driving sub-circuit, and a light-emitting control sub-circuit. The data writing and compensation sub-circuit is electrically connected to the driving sub-circuit, a first control signal terminal and a data voltage terminal, and is configured to transmit a data signal from the data voltage terminal to the driving sub-circuit under control of the first control signal terminal and compensate a threshold voltage of the driving sub-circuit. The light-emitting control sub-circuit is electrically connected to the driving sub-circuit, the data writing and compensation sub-circuit, a second control signal terminal, a first voltage terminal and a second voltage terminal, and is configured to transmit a first voltage signal output from the first voltage terminal to the driving sub-circuit and the data writing and compensation sub-circuit under control of the second control signal terminal and transmit a second voltage signal output from the second voltage terminal to the driving sub-circuit. The driving sub-circuit is electrically connected to the light-emitting sub-circuit, and is configured to input a signal output by the light-emitting control sub-circuit to a light-emitting sub-circuit. In some embodiments, the pixel circuit further includes a light-emitting sub-circuit. The light-emitting sub-circuit is further electrically connected to a third voltage terminal, and is configured to emit light under driving of a signal input from the driving sub-circuit and a third voltage signal from the third voltage terminal.

In some embodiments, the data writing and compensation sub-circuit includes: a first transistor, wherein a gate of the first transistor is electrically connected to the first control signal terminal, a first electrode of the first transistor is electrically connected to the data voltage terminal, and a second electrode of the first transistor is electrically connected to the driving sub-circuit; and a second transistor, wherein a gate of the second transistor is electrically connected to the first control signal terminal, a first electrode of the second transistor is electrically connected to the driving sub-circuit, and a second electrode of the second transistor is electrically connected to the light-emitting control sub-circuit.

In some embodiments, the data writing and compensation sub-circuit is further electrically connected to the light-emitting sub-circuit, and is configured to make voltages at both ends of the light-emitting sub-circuit equal under the control of the first control signal terminal.

In some embodiments, the data writing and compensation sub-circuit includes: a first transistor, wherein a gate of the first transistor is electrically connected to the first control signal terminal, a first electrode of the first transistor is electrically connected to the data voltage terminal, and a second electrode of the first transistor is electrically connected to the driving sub-circuit; a second transistor, wherein a gate of the second transistor is electrically connected to the first control signal terminal, a first electrode of the second transistor is electrically connected to the driving sub-circuit, and a second electrode of the second transistor is electrically connected to the light-emitting control sub-circuit; and a third transistor, wherein a gate of the third transistor is electrically connected to the first control signal terminal, a first electrode of the third transistor is electrically connected to the driving sub-circuit, and a second electrode of the third transistor is electrically connected to the light-emitting sub-circuit and the third voltage terminal.

In some embodiments, the driving sub-circuit includes: a storage capacitor, wherein a first end of the storage capacitor is electrically connected to the data writing and compensation sub-circuit and the light-emitting control sub-circuit; and a driving transistor, wherein a gate of the driving transistor is electrically connected to the second end of the storage capacitor and the data writing and compensation sub-circuit, a first electrode of the driving transistor is electrically connected to the data writing and compensation sub-circuit and the light-emitting control sub-circuit, and a second electrode of the driving transistor is electrically connected to the light-emitting sub-circuit.

In some embodiments, the light-emitting control sub-circuit includes: a fourth transistor, wherein a gate of the fourth transistor is electrically connected to the second control signal terminal, a first electrode of the fourth transistor is electrically connected to the first voltage terminal, and a second electrode of the fourth transistor is electrically connected to the data writing and compensation sub-circuit and the driving sub-circuit; and a fifth transistor, wherein a gate of the fifth transistor is electrically connected to the second control signal terminal, a first electrode of the fifth transistor is electrically connected to the data writing and compensation sub-circuit and the driving sub-circuit, and a second electrode of the fifth transistor is electrically connected to the second voltage terminal.

In some embodiments, the data writing and compensation sub-circuit includes: a first transistor, wherein a gate of the first transistor is electrically connected to the first control signal terminal, and a first electrode of the first transistor is electrically connected to the data voltage terminal; and a second transistor, wherein a gate of the second transistor is electrically connected to the first control signal terminal.

The driving sub-circuit includes: a storage capacitor, wherein a first end of the storage capacitor is electrically connected to a second electrode of the first transistor, and a second end of the storage capacitor is electrically connected to a first electrode of the second transistor; and a driving transistor, wherein a gate of the driving transistor is electrically connected to the first electrode of the second transistor and the second end of the storage capacitor, and a first electrode of the driving transistor is electrically connected to a second electrode of the second transistor.

The light-emitting control sub-circuit includes: a fourth transistor, wherein a gate of the fourth transistor is electrically connected to the second control signal terminal, a first electrode of the fourth transistor is electrically connected to the first voltage terminal, and a second electrode of the fourth transistor is electrically connected to the second electrode of the second transistor and the first electrode of the driving transistor; and a fifth transistor, wherein a gate of the fifth transistor is electrically connected to the second control signal terminal, a first electrode of the fifth transistor is electrically connected to the second electrode of the first transistor and the first end of the storage capacitor, and a second electrode of the fifth transistor is electrically connected to the second voltage terminal.

In some embodiments, the data writing and compensation sub-circuit further includes: a third transistor, wherein a gate of the third transistor is electrically connected to the first control signal terminal, a first electrode of the third transistor is electrically connected to the second electrode of the driving transistor, and a second electrode of the third transistor is electrically connected to the third voltage terminal.

In some embodiments, transistors in the data writing and compensation sub-circuit are P-type transistors, and transistors in the light-emitting control sub-circuit are N-type transistors. Alternatively, the transistors in the data writing and compensation sub-circuit are N-type transistors, and the transistors in the light-emitting control sub-circuit are P-type transistors.

In a second aspect, a display device including a plurality of pixel circuits according to the above technical solution is provided.

In a third aspect, a driving method of a pixel circuit configured to drive the pixel circuit according to any technical solution of the above technical solutions is provided. The driving method includes: time of a frame sequentially including a pre-charge period, a compensation period and a light-emitting period; in the pre-charge period, turning one the data writing and compensation sub-circuit under control of a first control signal terminal, and transmitting, by the data writing and compensation sub-circuit, a data signal output from the data voltage terminal to a driving sub-circuit, and turning one the light-emitting control sub-circuit under control of a second control signal terminal, and transmitting, by the light-emitting control sub-circuit, a signal from the first voltage terminal to the driving sub-circuit to pre-charge the driving sub-circuit; in the compensation period, turning one the data writing and compensation sub-circuit under the control of the first control signal terminal and compensating, by the data writing and compensation sub-circuit, a threshold voltage of the driving sub-circuit; and in the light-emitting period, turning one the light-emitting control sub-circuit under the control of the second control signal terminal, and inputting, by the light-emitting control sub-circuit, the first voltage signal from the first voltage terminal and a second voltage signal from a second voltage terminal to the driving sub-circuit, and emitting, by the light-emitting sub-circuit, light under driving of a driving signal output by the driving sub-circuit and a third voltage signal from the third voltage terminal.

In some embodiments, the time of the frame further includes a voltage stabilization period between the compensation period and the light-emitting period. The driving method further includes: in the voltage stabilization period, turning off the data writing and compensation sub-circuit under the control of the first control signal terminal, turning off the lighting-emitting control sub-circuit under the control of the second control signal terminal, so that signals in the driving sub-circuit remain unchanged.

In some embodiments, the data writing and compensation sub-circuit is further electrically connected to the light-emitting sub-circuit, and the driving method further includes: in the pre-charge period, turning one the data writing and compensation sub-circuit under the control of the first control signal terminal, and controlling voltages at both ends of the light-emitting sub-circuit to be equal while pre-charging the driving sub-circuit.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to these drawings.

DETAILED DESCRIPTION

Some embodiments of the present disclosure will be described with reference to the accompanying drawings. Obviously, the described embodiments are merely some but not all of the embodiments of the present disclosure. All other embodiments made on the basis of the embodiments of the present disclosure by a person of ordinary skill in the art shall be included in the protection scope of the present disclosure.

Figure 1:
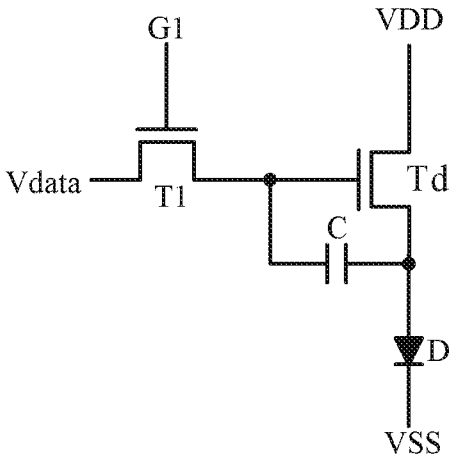
FIG. 1 is a schematic diagram showing a structure of a pixel circuit in the related art.

As shown in FIG. 1, in the related art, the pixel circuit in the organic light-emitting diode (OLED) display has a 2T1C structure, that is, the pixel circuit includes two transistors T1 and Td, and a storage capacitor C. The pixel circuit having the 2T1C structure is used to drive a light-emitting device D (i.e., the OLED) to emit light, thereby achieving the display of a corresponding pixel.

A luminance of the light-emitting device D (i.e., the OLED) when the light-emitting device D emits light depends on a driving current $I_{oled}$ flowing through the light-emitting device D. The driving current $I_{oled}$ is a current flowing through a driving transistor Td, and the driving current $I_{oled}$ may be expressed as:

$$I_{oled} = \frac{1}{2}\mu C_{OX}\frac{W}{L}(V_{GS} - V_{th})^2,$$

wherein $C_{OX}$ is a dielectric constant of a channel insulating layer of the driving transistor Td, μ is a channel carrier mobility of the driving transistor Td, $$\frac{W}{L}$$

is a width-to-length ratio of the driving transistor Td, $V_{GS}$ is a gate-to-source voltage of the driving transistor Td, and $V_{th}$ is a threshold voltage of the driving transistor Td. Since $C_{OX}$ and μ are constants, the driving current $I_{oled}$ will be affected by four variables W, L, $V_{GS}$ and $V_{th}$. Since W and L of the driving transistors Td of the pixel circuits of respective pixels in a same display are consistent, the luminance of the OLED is controlled by $V_{GS}$ and $V_{th}$.

Since an OLED display substrate in the OLED display is large, it is difficult to ensure a uniform thickness of a semiconductor layer through process(es), which may cause that switching characteristics of transistors at different positions are different, that is, the threshold voltages $V_{th}$ of respective transistors will be inconsistent, thereby causing that the driving currents $I_{oled}$ of the respective pixels are different in a case where the gate-to-source voltages $V_{GS}$ are the same, and thus luminances of the respective pixels are not uniform, which seriously affects a display effect.

Figure 2:
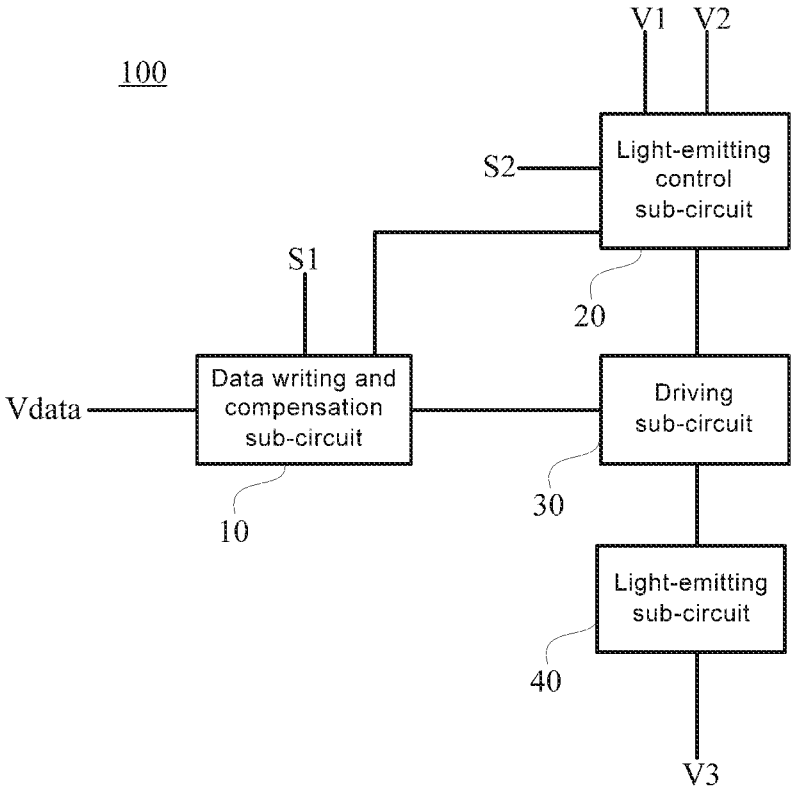
FIG. 2 is a schematic diagram showing a first structure of a pixel circuit, in accordance with some embodiments of the present disclosure.

Some embodiments of the present disclosure provide a pixel circuit 100. As shown in FIG. 2, the pixel circuit 100 includes a data writing and compensation sub-circuit 10, a light-emitting control sub-circuit 20, a driving sub-circuit 30 and a light-emitting sub-circuit 40.

The data writing and compensation sub-circuit 10 is electrically connected to the driving sub-circuit 30, a first control signal terminal S1 and a data voltage terminal Vdata. The data writing and compensation sub-circuit 10 is configured to input a data signal from the data voltage terminal Vdata to the driving sub-circuit 30 under control of the first control signal terminal S1, and to compensate a threshold voltage Vth of the driving sub-circuit 30 under the control of the first control signal terminal S1.

The light-emitting control sub-circuit 20 is electrically connected to the driving sub-circuit 30, the data writing and compensation sub-circuit 10, a second control signal terminal S2, a first voltage terminal V1 and a second voltage terminal V2. The light-emitting control sub-circuit 20 is configured to input a first voltage signal from the first voltage terminal V1 to the driving sub-circuit 30 and the data writing and compensation sub-circuit 10 under control of the second control signal terminal S2, and to input a second voltage signal from the second voltage terminal V2 to the driving sub-circuit 30 under the control of the second control signal terminal S2.

The driving sub-circuit 30 is further electrically connected to the light-emitting sub-circuit 40 in addition to the data writing and compensation sub-circuit 10 and the light-emitting control sub-circuit 20, and is configured to input a signal output by the light-emitting control sub-circuit 20 to the light-emitting sub-circuit 40.

The light-emitting sub-circuit 40 is further electrically connected to a third voltage terminal V3 in addition to the driving sub-circuit 30, and is configured to emit light under driving of a signal input from the driving sub-circuit 30 and a third voltage signal from the third voltage terminal V3. For example, the light-emitting sub-circuit 40 includes a light-emitting device, such as an OLED.

In the above pixel circuit 100, the threshold voltage Vth of the driving sub-circuit 30 is compensated under actions of the data writing and compensation sub-circuit 10 and the light-emitting control sub-circuit 20, thereby eliminating an influence of the threshold voltage Vth on the driving current $I_{oled}$, improving service lives of transistors in the driving sub-circuit 30 in a display panel, avoiding a problem that the display luminance of the pixels in the display panel are different due to a difference in drifts of the threshold voltages Vth of different transistors, and improving a luminance uniformity among the pixels.

In some embodiments, with reference to FIG. 2 again, the data writing and compensation sub-circuit 10 is not electrically connected to the light-emitting sub-circuit 40. In a driving process of the pixel circuit 100, in order to prevent the light-emitting sub-circuit 40 from emitting light in a pre-charge period of a frame, a signal from the first voltage terminal V1 is used to control the driving sub-circuit 30 to be turned off, so that the light-emitting sub-circuit 40 does not emit light.

Figure 4:
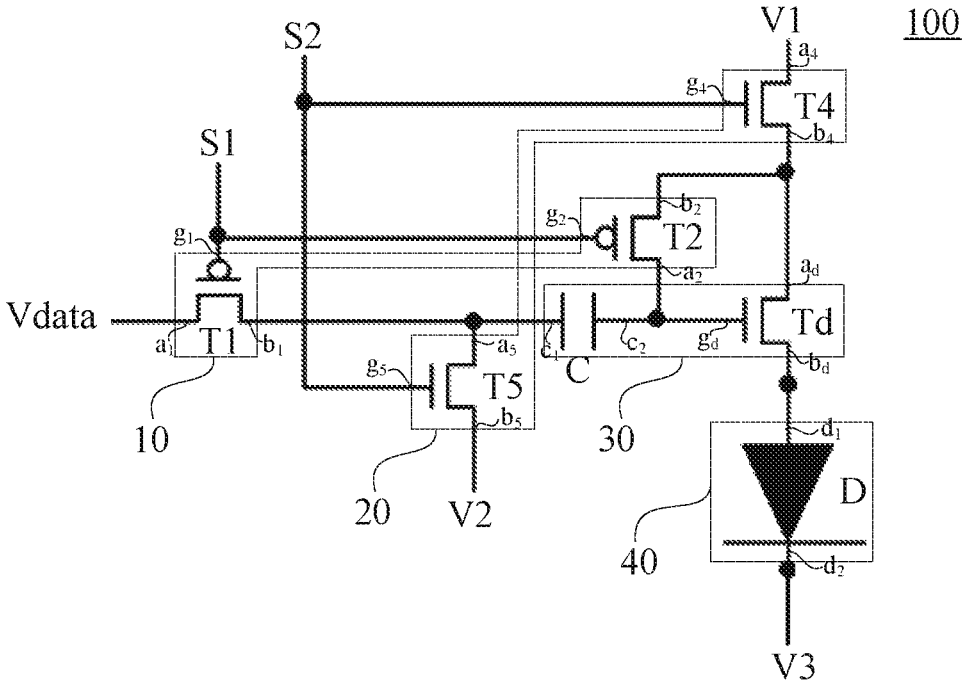
FIG. 4 is a schematic diagram showing a first structure of sub-circuits of a pixel circuit, in accordance with some embodiments of the present disclosure.

In some embodiments, as shown in FIG. 4, the data writing and compensation sub-circuit 10 includes a first transistor T1 and a second transistor T2.

A gate $g_1$ of the first transistor T1 is electrically connected to the first control signal terminal S1, a first electrode $a_1$ of the first transistor T1 is electrically connected to the data voltage terminal Vdata, and a second electrode $b_1$ of the first transistor T1 is electrically connected to the driving sub-circuit 30.

A gate $g_2$ of the second transistor T2 is electrically connected to the first control signal terminal S1, a first electrode $a_2$ of the second transistor T2 is electrically connected to the driving sub-circuit 30, and a second electrode $b_2$ of the second transistor T2 is electrically connected to the light-emitting control sub-circuit 20.

As some possible designs, the data writing and compensation sub-circuit 10 further includes a plurality of switching transistors in parallel with the first transistor T1, and/or a plurality of switching transistors in parallel with the second transistor T2. The above is merely an example of a specific structure of the data writing and compensation sub-circuit 10. Other structures having a same function as the data writing and compensation sub-circuit 10 are not elaborated herein, but all shall be included in the protection scope of the present disclosure.

Figure 3:
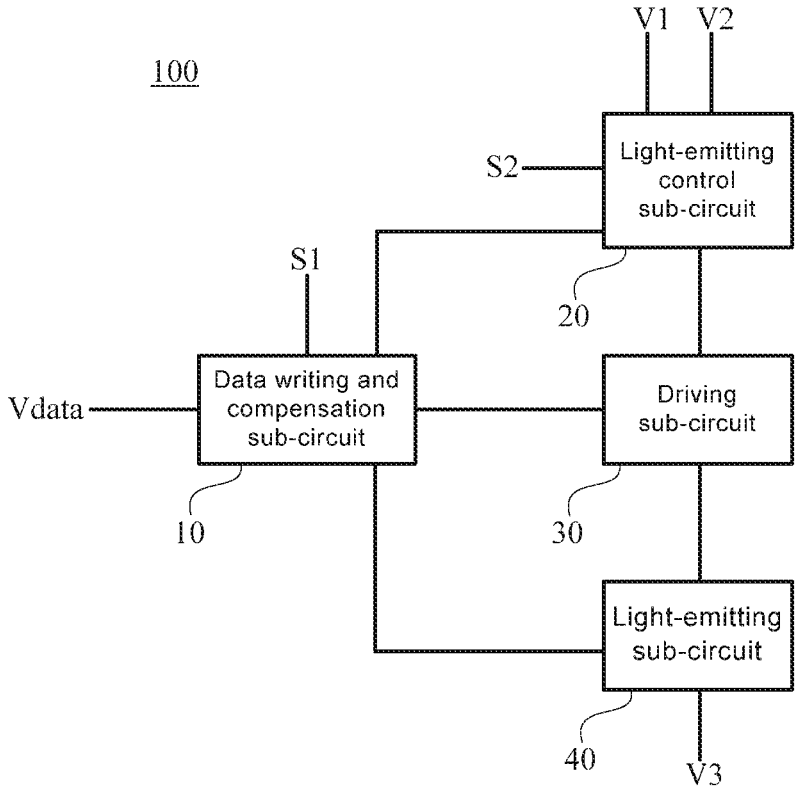
FIG. 3 is a schematic diagram showing a second structure of a pixel circuit, in accordance with some embodiments of the present disclosure.

Further, as shown in FIG. 3, the data writing and compensation sub-circuit 10 is also electrically connected to the light-emitting sub-circuit 40, and is configured to make voltages at both terminals of the light-emitting sub-circuit 40 equal under the control of the first control signal terminal S1.

Here, the light-emitting sub-circuit 40 may emit light based on an electric field formed by a difference between the voltages at both terminals of the light-emitting sub-circuit 40. In the driving process of the pixel circuit 100, the data writing and compensation sub-circuit 10 is communicated with both terminals of the light-emitting sub-circuit 40 in the pre-charge period of a frame, so that the voltages at both terminals of the light-emitting sub-circuit 40 are equal, and no electric field is generated, so that the light-emitting sub-circuit 40 does not emit light.

Figure 5A:
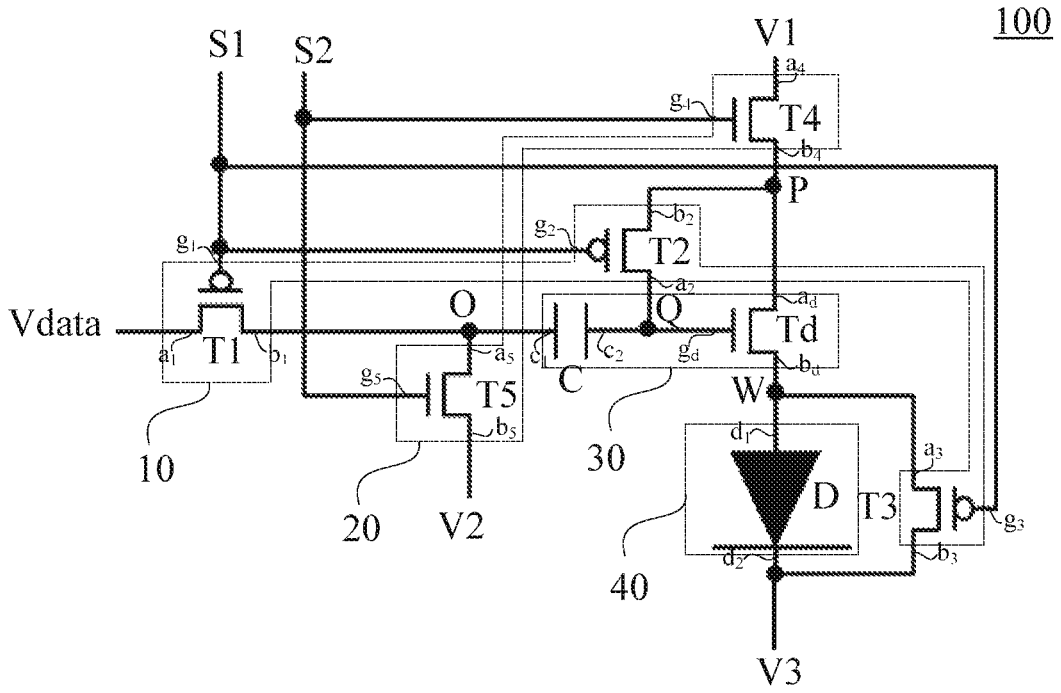
FIG. 5*a* is a schematic diagram showing a second structure of sub-circuits of a pixel circuit, in accordance with some embodiments of the present disclosure.

In some embodiments, as shown in FIG. 5*a*, in a case where the data writing and compensation sub-circuit 10 is also electrically connected to the light-emitting sub-circuit 40, the data writing and compensation sub-circuit 10 further includes a third transistor T3 in addition to the first transistor T1 and the second transistor T2.

A gate $g_3$ of the third transistor T3 is electrically connected to the first control signal terminal S1, a first electrode $a_3$ of the third transistor T3 is electrically connected to the driving sub-circuit 30, and a second electrode $b_3$ of the third transistor T3 is electrically connected to the light-emitting sub-circuit 40 and the third voltage terminal V3. A reference with regard to connections of the first transistor T1 and the second transistor T2 is made to the above description with regard to the connections of the first transistor T1 and the second transistor T2.

As some possible designs, the data writing and compensation sub-circuit 10 further includes a plurality of switching transistors in parallel with the third transistor T3. The above is merely an example of the data writing and compensation sub-circuit 10. Other structures having the same function as the data writing and compensation sub-circuit 10 are not elaborated herein, but all shall be included in the protection scope of the present disclosure.

As shown in FIGS. 4 and 5*a*, the driving sub-circuit 30 includes a storage capacitor C and a driving transistor Td.

A first end $c_1$ of the storage capacitor C is electrically connected to the data writing and compensation sub-circuit 10 and the light-emitting control sub-circuit 20.

A gate $g_d$ of the driving transistor Td is electrically connected to a second end $c_2$ of the storage capacitor C and the data writing and compensation sub-circuit 10, a first electrode $a_d$ of the driving transistor Td is electrically connected to the data writing and compensation sub-circuit 10 and the light-emitting control sub-circuit 20, and a second electrode $b_d$ of the driving transistor Td is electrically connected to the light-emitting sub-circuit 40.

As some possible designs, the driving sub-circuit 30 further includes a plurality of transistors in parallel with the driving transistor Td. The above is merely an example of the driving sub-circuit 30. Other structures having a same function as the driving sub-circuit 30 are not elaborated herein, but all shall be included in the protection scope of the present disclosure.

In some embodiments, as shown in FIGS. 4 and 5*a*, the light-emitting control sub-circuit 20 includes a fourth transistor T4 and a fifth transistor T5.

A gate $g_4$ of the fourth transistor T4 is electrically connected to the second control signal terminal S2, a first electrode $a_4$ of the fourth transistor T4 is electrically connected to the first voltage terminal V1, and a second electrode $b_4$ of the fourth transistor T4 is electrically connected to the data writing and compensation sub-circuit 10 and driving sub-circuit 30.

A gate $g_5$ of the fifth transistor T5 is electrically connected to the second control signal terminal S2, a first electrode $a_5$ of the fifth transistor T5 is electrically connected to the data writing and compensation sub-circuit 10 and the driving sub-circuit 30, and a second electrode $b_5$ of the fifth transistor T5 is electrically connected to the second voltage terminal V2.

As some possible designs, the light-emitting control sub-circuit 20 further includes a plurality of switching transistors in parallel with the fourth transistor T4, and/or a plurality of switching transistors in parallel with the fifth transistor T5. The above is merely an example of the light-emitting control sub-circuit 20. Other structures having a same function as the light-emitting control sub-circuit 20 are not elaborated herein, but all shall be included in the protection scope of the present disclosure.

In some embodiments, as shown in FIG. 4, the light-emitting sub-circuit 40 includes a light-emitting device D. An anode $d_1$ of the light-emitting device D is electrically connected to the driving sub-circuit 30, and a cathode $d_2$ of the light-emitting device D is electrically connected to the third voltage terminal V3. The light-emitting device D is, for example, an OLED.

In some other embodiments, as shown in FIG. 5*a*, the light-emitting sub-circuit 40 includes the light-emitting device D. The anode $d_1$ of the light-emitting device D is electrically connected to the driving sub-circuit 30 and the data writing and compensation sub-circuit 10, and the cathode $d_2$ of the light-emitting device D is electrically connected to the third voltage terminal V3 and the data writing and compensation sub-circuit 10. The light-emitting device D is, for example, the OLED.

Based on the above description of structures of respective sub-circuits of the pixel circuit 100, a specific structure of the pixel circuit 100 will be exemplarily described below.

In some examples, with reference to FIG. 4 again, in the pixel circuit 100, the data writing and compensation sub-circuit 10 includes the first transistor T1 and the second transistor T2. The gate $g_1$ of the first transistor T1 is electrically connected to the first control signal terminal S1, and the first electrode $a_1$ of the first transistor T1 is electrically connected to the data voltage terminal Vdata. The gate $g_2$ of the second transistor T2 is electrically connected to the first control signal terminal S1.

The driving sub-circuit 30 includes the storage capacitor C and the driving transistor Td. The first end $c_1$ of the storage capacitor C is electrically connected to the second electrode $b_1$ of the first transistor T1, and the second end $c_2$ of the storage capacitor C is electrically connected to the first electrode $a_2$ of the second transistor T2. The gate $g_d$ of the driving transistor Td is electrically connected to the first electrode $a_2$ of the second transistor T2 and the second end $c_2$ of the storage capacitor C, and the first electrode $a_d$ of the driving transistor Td is electrically connected to the second electrode $b_2$ of the second transistor T2.

The light-emitting control sub-circuit 20 includes the fourth transistor T4 and the fifth transistor T5. The gate $g_4$ of the fourth transistor T4 is electrically connected to the second control signal terminal V2, the first electrode $a_4$ of the fourth transistor T4 is electrically connected to the first voltage terminal V1, and the second electrode $b_4$ of the fourth transistor T4 is electrically connected to the second electrode $b_2$ of the second transistor T2 and the first electrode $a_d$ of the driving transistor Td. The gate $g_5$ of the fifth transistor T5 is electrically connected to the second control signal terminal S2, the first electrode $a_5$ of the fifth transistor T5 is electrically connected to the second electrode $b_1$ of the first transistor T1 and the first end $c_1$ of the storage capacitor C, and the second electrode $b_5$ of the fifth transistor T5 is electrically connected to the second voltage terminal V2.

The light-emitting sub-circuit 40 includes the light-emitting device D. The anode $d_1$ of the light-emitting device D is electrically connected to the second electrode $b_d$ of the driving transistor Td, and the cathode $d_2$ of the light-emitting device D is electrically connected to the third voltage terminal V3.

In some other examples, with reference to FIG. 5*a* again, the pixel circuit 100 further includes the third transistor T3 in addition to the first transistor T1, the second transistor T2, the fourth transistor T4, the fifth transistor T5, the driving transistor Td, the storage capacitor C and the light-emitting device D.

The gate $g_3$ of the third transistor T3 is electrically connected to the first control signal terminal S1, the first electrode $a_3$ of the third transistor T3 is electrically connected to the second electrode $b_d$ of the driving transistor Td and the anode $d_1$ of the light-emitting device D, and the second electrode $b_3$ of the third transistor T3 is electrically connected to the third voltage terminal V3 and the cathode $d_2$ of the light-emitting device D.

It will be further noted that, as shown in FIG. 5*a*, the gate $g_1$ of the first transistor T1 is electrically connected to the first control signal terminal S1, the first electrode $a_1$ of the first transistor T1 is electrically connected to the data voltage terminal Vdata, and the second electrode $b_1$ of the first transistor T1 is electrically connected to a first point O.

The gate $g_2$ of the second transistor T2 is electrically connected to the first control signal terminal S1, the second electrode $b_2$ of the second transistor T2 is electrically connected to a second point P, and the first electrode $a_2$ of the second transistor T2 is electrically connected to a third point Q.

The gate $g_3$ of the third transistor T3 is electrically connected to the first control signal terminal S1, the first electrode $a_3$ of the third transistor T3 is electrically connected to a fourth point W, and the second electrode $b_3$ of the third transistor T3 is electrically connected to the third voltage terminal V3.

The first end $c_1$ of the storage capacitor C is electrically connected to the first point O, and the second end $c_2$ of the storage capacitor C is electrically connected to the third point Q.

The gate $g_d$ of the driving transistor Td is electrically connected to the third point Q, the first electrode $a_d$ of the driving transistor Td is electrically connected to the second point P, and the second electrode $b_d$ of the driving transistor Td is electrically connected to the fourth point W.

The gate $g_4$ of the fourth transistor T4 is electrically connected to the second control signal terminal S2, the first electrode $a_4$ of the fourth transistor T4 is electrically connected to the first voltage terminal V1, and the second electrode $b_4$ of the fourth transistor T4 is electrically connected to the second point P.

The gate $g_5$ of the fifth transistor T5 is electrically connected to the second control signal terminal S2, the first electrode $a_5$ of the fifth transistor T5 is electrically connected to the first point O, and the second electrode $b_5$ of the fifth transistor T5 is electrically connected to the second voltage terminal V2.

The anode $d_1$ of the light-emitting device D is electrically connected to the fourth point W, and the cathode $d_2$ of the light-emitting device D is electrically connected to the third voltage terminal V3. The anode $d_1$ and the cathode $d_2$ of the light-emitting device D are electrically connected to the first electrode $a_3$ and the second electrode $b_3$ of the third transistor T3, respectively.

The pixel circuit 100 shown in FIG. 5*a* includes six transistors (T1-T5, and Td) and a capacitor (C), that is, the pixel circuit 100 has a 6T1C circuit structure. Thus, on one hand, the influence of the threshold voltage Vth on the driving current $I_{oled}$ is directly eliminated, which not only stabilizes signals in the pixel circuit 100, but also greatly improves working lives of the transistors. On the other hand, compared with a pixel circuit having a 7T1C structure, a 7T2C structure or a 8T1C structure in the related art, the pixel circuit having the 6T1C structure provided by the embodiments of the present disclosure has a simple structure and a low cost, there is no need to add new process(es), and a stability of a driving circuit of the OLED may be greatly improved.

In some embodiments, in the pixel circuit 100, transistors in the data writing and compensation sub-circuit 10 are P-type transistors, and transistors in the light-emitting control sub-circuit 20 are N-type transistors. For example, as shown in FIG. 4, the first transistor T1 and the second transistor T2 in the data writing and compensation sub-circuit 10 are both P-type transistors. As shown in FIG. 5*a*, the first transistor T1, the second transistor T2 and the third transistor T3 in the data writing and compensation sub-circuit 10 are all P-type transistors. The fourth transistor T4 and the fifth transistor T5 in the light-emitting control sub-circuit 20 are both N-type transistors.

Alternatively, in the pixel circuit 100, the transistors in the data writing and compensation sub-circuit 10 are N-type transistors, and the transistors in the light-emitting control sub-circuit 20 are P-type transistors.

Thus, the pixel circuit 100 includes a plurality of N-type transistors and a plurality of P-type transistors, i.e., the pixel circuit 100 has a hybrid structure. That is, a driving circuit of the OLED having a complementary metal oxide semiconductor (CMOS) structure is adopted by the pixel circuit 100, which eliminates an influence of the drift of the threshold voltage Vth, thereby eliminating a problem of instable signals due to the influence of the drift of the threshold voltage Vth, so that the driving circuit of the OLED is more stable, and problems of a poor stability of the pixel circuit and a poor uniformity due to a fact that transistors of a single type (only P-type or only N-type) are adopted in the driving circuit of the OLED in the related art are solved.

Based on the above description of the pixel circuit 100, a specific driving process of the pixel circuit 100 will be described in detail below with reference to FIGS. 5*a*, 5*b*, 6*a*, 6*b* and 7-10.

It will be noted that, first, the embodiments of the present disclosure do not limit the types of transistors in the respective sub-circuits of the pixel circuit 100. That is, any one of the first transistor T1, the second transistor T2, the third transistor T3, the fourth transistor T4, the fifth transistor T5 and the driving transistor Td described above may be N-type transistors or P-type transistors.

In some embodiments, in the pixel circuit 100, the transistors (i.e., the first transistor T1, the second transistor T2 and the third transistor T3) in the data writing and compensation sub-circuit 10 are N-type transistors, and the transistors (i.e., the fourth transistor T4 and the fifth transistor T5) in the light-emitting control sub-circuit 20 are P-type transistors. Alternatively, the transistors in the data writing and compensation sub-circuit 10 are P-type transistors, and the transistors in the light-emitting control sub-circuit 20 are N-type transistors.

A description will be made below by taking an example in which the transistors in the data writing and compensation sub-circuit 10 are P-type transistors and the transistors in the light-emitting control sub-circuit 20 are N-type transistors.

The first electrode a of the transistor in the pixel circuit 100 is a drain d, and the second electrode b is a source s. Alternatively, the first electrode a is the source s, and the second electrode b is the drain d, which is not limited in the embodiments of the present disclosure.

In addition, in some embodiments, according to different conductive methods of transistors, the transistors in the pixel circuit 100 described above are divided into enhancement-mode transistors and depletion-mode transistors, which is not limited in the embodiments of the present disclosure.

Figure 5B:
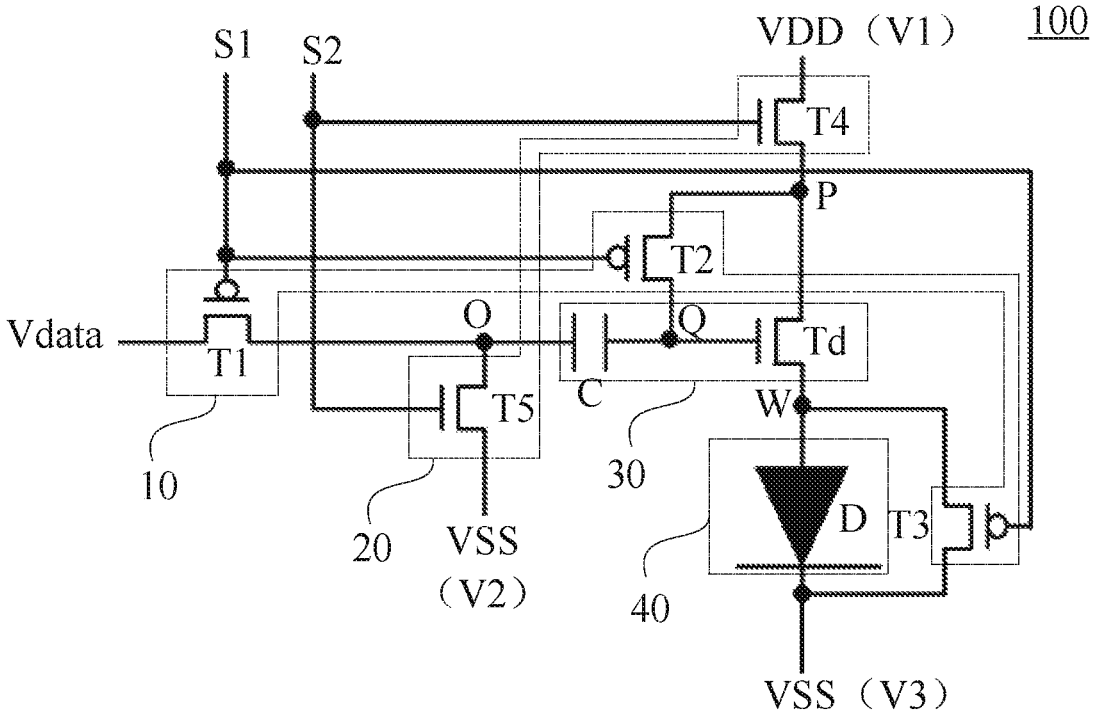
FIG. 5*b* is a schematic diagram showing a third structure of sub-circuits of a pixel circuit, in accordance with some embodiments of the present disclosure.

Second, with reference to FIG. 5*b*, in the embodiments of the present disclosure, the first voltage signal from the first voltage terminal V1 is at a high level VDD, the second voltage signal from the second voltage terminal V2 is at a low level, and the third voltage signal from the third voltage terminal V3 is at a low level. In some embodiments, the second voltage signal from the second voltage terminal V2 and the third voltage signal from the third voltage terminal V3 are at a same low level VSS. For example, the second voltage terminal V2 and the third voltage terminals V3 are both grounded such that the second voltage signal and the third voltage signal are both ground signals.

It will be noted that the terms "a high level" and "a low level" described above merely indicate a relative magnitude relationship between voltages that are input. In some other embodiments, the first voltage signal from the first voltage terminal V1 is at a low level, and the second voltage signal from the second voltage terminal V2 is at a high level VDD.

A description will be made below by taking an example in which the first voltage signal from the first voltage terminal V1 is at the high level VDD, the second voltage terminal V2 and the third voltage terminal V3 are both grounded, and the voltage signals from the second voltage terminal V2 and the third voltage terminal V3 are at the low level VSS.

Figure 6A:
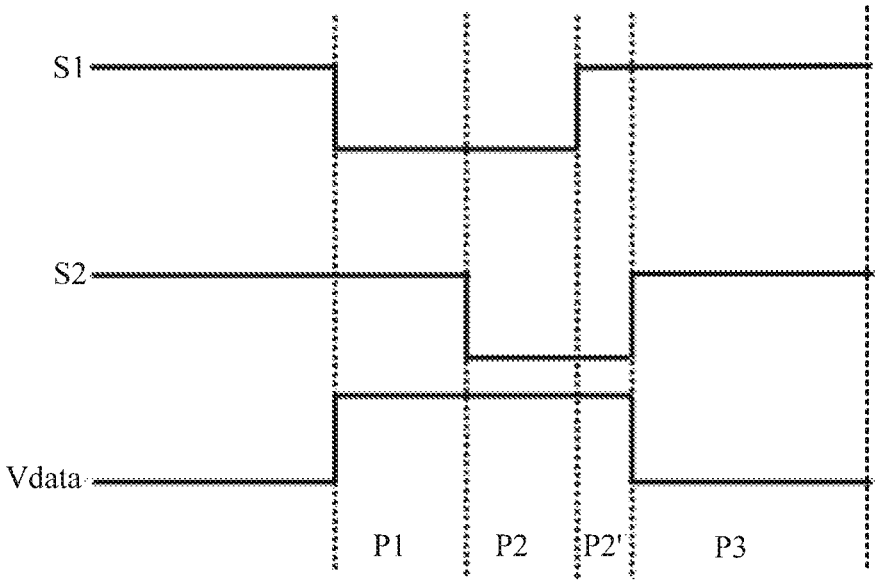
FIG. 6*a* is a diagram showing a first driving timing of a pixel circuit, in accordance with some embodiments of the present disclosure.
Figure 6B:
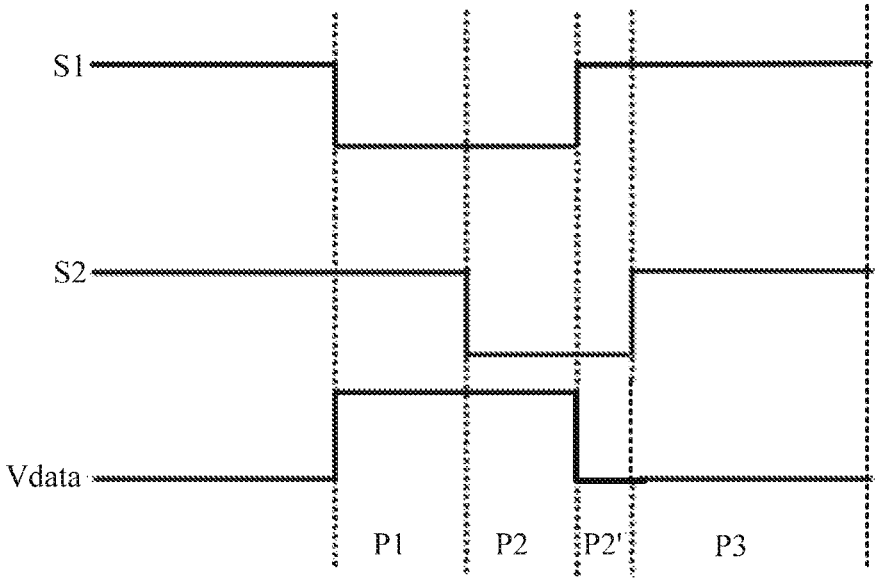
FIG. 6*b* is a diagram showing a second driving timing of a pixel circuit, in accordance with some embodiments of the present disclosure.

As shown in FIGS. 6*a* and 6*b*, time of a frame of the pixel circuit 100 includes a pre-charge period P1, a compensation period P2 and a light-emitting period P3.

Figure 7:
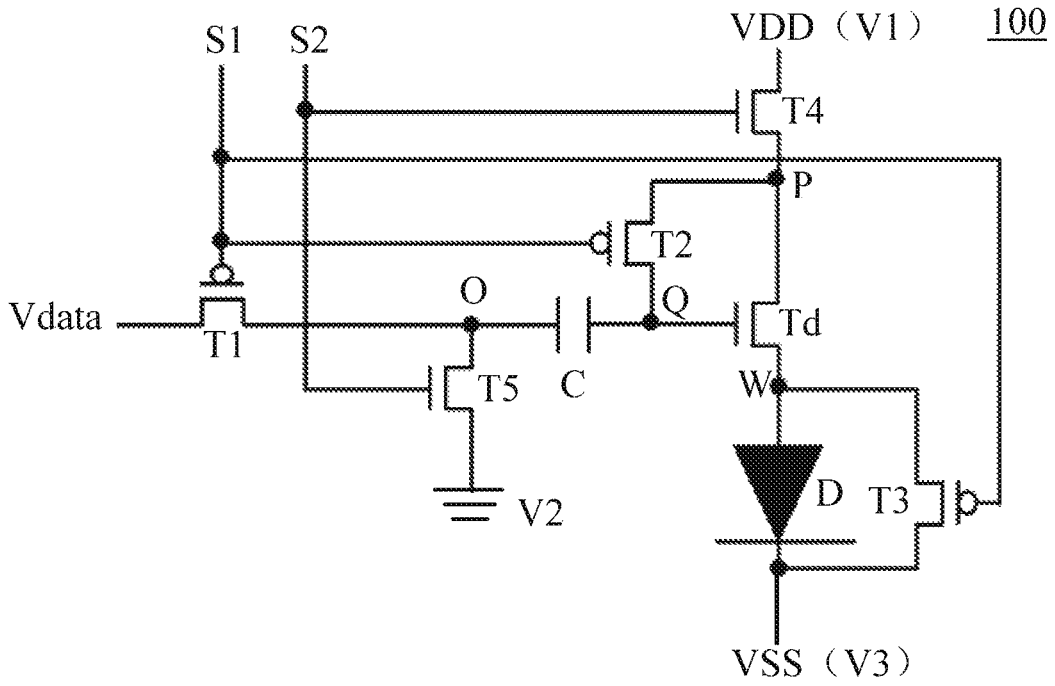
FIGS. 7-10 are schematic diagrams respectively showing structures of a pixel circuit in respective periods in a driving process of the pixel circuit, in accordance with some embodiments of the present disclosure.

In the pre-charge period P1 of the frame, as shown in FIGS. 6*a* and 6*b*, a low level turn-on signal is input via the first control signal terminal S1, and a high level turn-on signal is input via the second control signal terminal S2. Based on this, as shown in FIG. 7, the first transistor T1, the second transistor T2, the third transistor T3, the fourth transistor T4, the fifth transistor T5 and the driving transistor Td of the pixel circuit 100 are all turned on.

The low level turn-on signal is input via the first control signal terminal S1 to control the first transistor T1, the second transistor T2 and the third transistor T3 to be turned on, and a signal from the data voltage terminal Vdata is transmitted to the first point O through the first transistor T1.

The high level turn-on signal is input via the second control signal terminal S2 to control the fourth transistor T4 and the fifth transistor T5 to be turned on, and the first voltage signal VDD from the first voltage terminal V1 is transmitted to the third point Q through the fourth transistor T4 and the second transistor T2.

The driving transistor Td is turned on under control of the third point Q (of course, the driving transistor Td may also be turned off under the control of the third point O).

The third transistor T3 is in a turn-on state. Since the first electrode $a_3$ of the third transistor T3 is electrically connected to the anode $d_1$ of the light-emitting device D, and the second electrode $b_3$ of the third transistor T3 is electrically connected to the cathode $d_2$ of the light-emitting device D, voltages at the cathode $d_2$ and the anode $d_1$ of the light-emitting device D are equal, and the light-emitting device D does not emit light.

It will be noted that, in a case where the pixel circuit 100 does not include the third transistor T3, the first voltage signal from the first voltage terminal V1 is changed to a low level, so that a potential at the third point Q is at a low level, thereby the driving transistor Td is turned off under the control of the third point Q, thereby ensuring that the light-emitting device D does not emit light in the pre-charge period P1.

Thus, at an end of the pre-charge period P1, a voltage $V_O$ at the first point O is equal to Vdata, and a voltage $V_Q$ at the third point Q is equal to VDD. In some embodiments, VDD is a power supply voltage provided by a system external to the pixel circuit 100.

Figure 8:
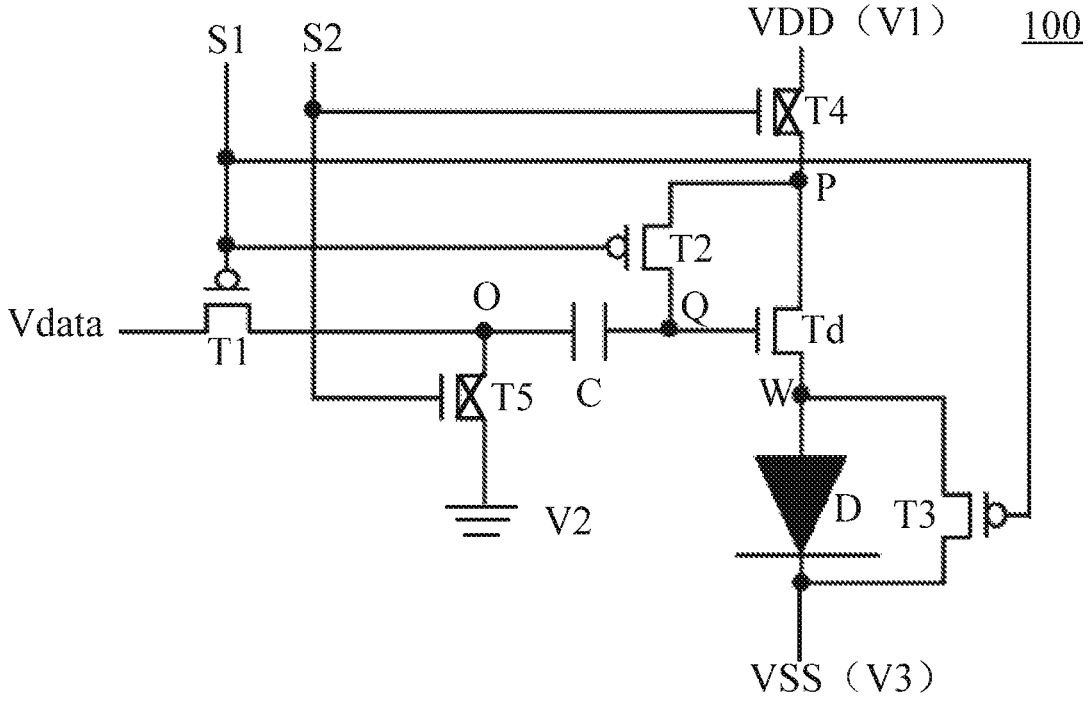

In the compensation period P2 of the frame, the low level turn-on signal is input via the first control signal terminal S1, and a low level turn-off signal is input via the second control signal terminal S2. Based on this, an equivalent circuit diagram of the pixel circuit 100 shown in FIGS. 5*a* and 5*b* is as shown in FIG. 8. The first transistor T1 is turned on, the second transistor T2 is turned on, the third transistor T3 is turned on, the driving transistor Td is turned on, the fourth transistor T4 is turned off, and the fifth transistor T5 is turned off (the transistors in a turn-off state are indicated by symbols "x").

The low level turn-on signal is input via the first control signal terminal S1 to control the first transistor T1, the second transistor T2 and the third transistor T3 to be turned on, and the signal from the data voltage terminal Vdata is transmitted to the first point O through the first transistor T1. A turning on of the second transistor T2 causes the gate $g_d$ of the driving transistor Td to be electrically connected to the first electrode $a_d$ of the driving transistor Td. That is, the turning on of the second transistor T2 causes the second point P to be electrically connected to the third point Q.

In this case, the voltage $V_W$ at the fourth point W is released, so that the voltage $V_W$ at the fourth point W is VSS ($V_W$=VSS). Moreover, the voltage $V_Q$ at the third point Q is released, the voltage $V_Q$ is decreased from VDD until the gate-to-source voltage of the driving transistor Td Vgs is a difference of $V_Q$ and $V_W$, i.e., Vth (Vgs=$V_Q$−$V_W$=Vth), which means that the driving transistor Td is turned off, and thus the voltage $V_Q$ at the third point Q is stopped being released. In this case, the voltage $V_Q$ at the third point Q is a sum of Vth and $V_W$, i.e., a sum of Vth and VSS ($V_Q$=Vth+$V_W$=Vth+VSS), thereby compensating the threshold voltage Vth of the driving sub-circuit 30 (i.e., the driving transistor Td). Vth is the threshold voltage of the driving transistor Td. In some embodiments, VSS is a power supply voltage of the system external to the pixel circuit 100.

Thus, at an end of the compensation period P2, the voltage $V_O$ at the first point O is equal to Vdata, and the voltage $V_Q$ at the third point Q is a sum of Vth and VSS ($V_Q$=Vth+VSS).

Figure 10:
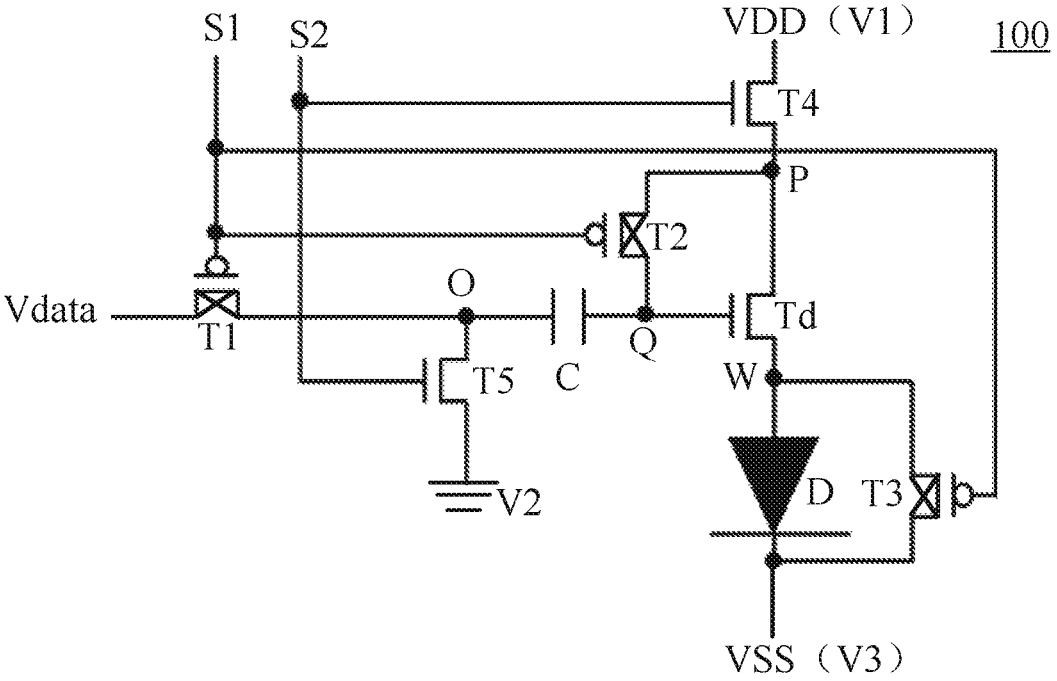

In the light-emitting period P3 of the frame, a high level turn-off signal is input via the first control signal terminal S1, and the high level turn-on signal is input via the second control signal terminal S2. Based on this, the equivalent circuit diagram of the pixel circuit 100 shown in FIG. 5*a* and FIG. 5*b* is as shown in FIG. 10. The first transistor T1 is turned off, the second transistor T2 is turned off, the third transistor T3 is turned off, the fourth transistor T4 is turned on, the fifth transistor T5 is turned on, and the driving transistor Td is turned on.

The high level turn-on signal is input via the second control signal terminal S2 to control the fifth transistor T5 to be turned on, and the second voltage signal from the second voltage terminal V2 (a ground terminal) is transmitted to the first point O through the fifth transistor T5. In this case, the voltage $V_O$ at the first point O is suddenly changed to 0, and a variable Δ is equal to Vdata.

Under a bootstrap action of the storage capacitor C, the voltage $V_Q$ at the third point Q will also be changed, $V_Q$ is changed to be a sum of Vth, VSS and Vdata (i.e., Vth+VSS+Vdata), and the voltage $V_Q$ at the third point Q controls the driving transistor Td to be turned on.

The high level turn-on signal is input via the second control signal terminal S2 to control the fourth transistor T4 to be turned on, the first voltage signal (VDD) from the first voltage terminal V1 is transmitted to the driving transistor Td through the fourth transistor T4, and the light-emitting device D emits light under driving of a driving signal output from the driving transistor Td and the third voltage signal (VSS) from the third voltage terminal V3.

It will be seen that, in the light-emitting period P3 of the frame, the voltage $V_O$ at the first point O is 0, and the voltage $V_Q$ at the third point Q is a sum of Vdata, Vth and VSS ($V_Q$=Vdata+Vth+VSS).

In this case, after the driving transistor Td is turned on, since the driving transistor Td is an N-type transistor, and the N-type transistor is in a saturation and turn-on state when a difference of Vgs and Vth is less than or equal to Vds (i.e., Vgs−Vth≤Vds), when the difference of Vgs and Vth of the driving transistor Td is less than or equal to Vds (i.e., Vgs−Vth≤Vds), the driving transistor Td may be in the saturation and turn-on state, wherein Vgs is the gate-to-source voltage of the driving transistor Td, and Vds is a drain-to-source voltage of the driving transistor Td. In this case, the driving current $I_{oled}$ flowing through the driving transistor Td is:

$$\begin{aligned} I_{oled} &= \frac{1}{2}\mu C_{OX}\frac{W}{L}(V_{GS}-V_{th})^2 \\ &= \frac{1}{2}\mu C_{OX}\frac{W}{L}(Vdata+Vth+VSS-VSS-Voled-V_{th})^2 \\ &= \frac{1}{2}\mu C_{OX}\frac{W}{L}(Vdata-Voled)^2. \end{aligned}$$

$C_{OX}$ is the dielectric constant of the channel insulating layer of the driving transistor Td, μ is the channel carrier mobility of the driving transistor Td, and $$\frac{W}{L}$$

is the width-to-length ratio of the driving transistor Td. Voled is a voltage of the light-emitting device D when the light-emitting device D emits light.

As will be seen from the above formula, the driving current $I_{oled}$ is only related to a structure of the driving transistor Td (the structure determines $C_{OX}$, μ and $$\frac{W}{L})$$

and the data signal from the data voltage terminal Vdata, and is independent of the threshold voltage Vth of the driving transistor Td, thereby eliminating an influence of the threshold voltage Vth of the driving transistor Td on the luminance of the light-emitting device D, and improving a luminance uniformity of the light-emitting device D.

In addition, since the driving current $I_{oled}$ of the driving transistor Td does not include the VSS term, a problem of a non-uniform display due to a voltage drop on the VSS signal line may be solved.

Figure 9:
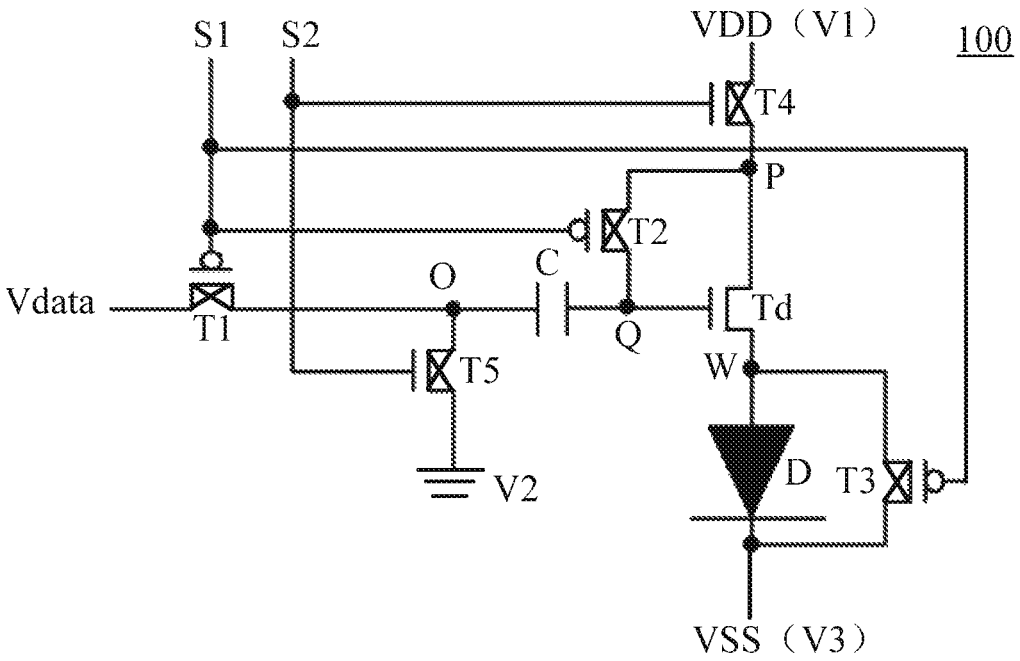

In some embodiments, with reference to FIGS. 6*a* and 6*b* again, a voltage stabilization period P2' is further included between the compensation period P2 and the light-emitting period P3. In the voltage stabilization period P2' of the frame, the high level turn-off signal is input via the first control signal terminal S1, and the low level turn-off signal is input via the second control signal terminal S2. Based on this, the equivalent circuit diagram of the pixel circuit 100 shown in FIGS. 5*a* and 5*b* is as shown in FIG. 9. The first transistor T1 is turned off, the second transistor T2 is turned off, the third transistor T3 is turned off, the fourth transistor T4 is turned off, and the fifth transistor T5 is turned off.

Here, in the voltage stabilization period P2', the signal from the data voltage terminal Vdata is, for example, the high level signal shown in FIG. 6*a*, or, for example, the low level signal shown in FIG. 6*b*.

In the voltage stabilization period P2', the high level turn-off signal is input via the first control signal terminal S1 to control the first transistor T1, the second transistor T2 and the third transistor T3 to be turned off. The low level turn-off signal is input via the second control signal terminal S2 to control the fourth transistor T4 and the fifth transistor T5 to be turned off. In this case, the voltage $V_O$ at the first point O is maintained equal to Vdata, and the voltage $V_Q$ at the third point Q is maintained to be the sum of Vth and VSS (i.e., Vth+VSS).

That is, at an end of the voltage stabilization period P2', the voltage at the first point O $V_O$ is equal to Vdata, and the voltage $V_Q$ at the third point Q is the sum of Vth and VSS (VQ=Vth+VSS).

Thus, a certain buffer time is provided for signal transmissions to respective regions in the display panel in the voltage stabilization period P2', so that $V_O$ of each pixel circuit in the display panel is maintained equal to Vdata, $V_Q$ is maintained to be the sum of Vth and VSS (i.e., Vth+VSS), and there will be no problem that $V_O$ and $V_Q$ of some pixel circuits do not reach set voltages (i.e., $V_O$=Vdata, and $V_Q$=Vth+VSS) due to a signal delay, thereby making a full preparation for the next light-emitting period P3.

In some embodiments, the pixel circuit 100 does not include the third transistor T3, and turn-on and turn-off conditions of other transistors (i.e., the first transistor T1, the second transistor T2, the fourth transistor T4, the fifth transistor T5 and the driving transistor Td) in the pixel circuit 100 in respective periods of the frame are the same as the turn-on and turn-off conditions described above.

Figure 12:
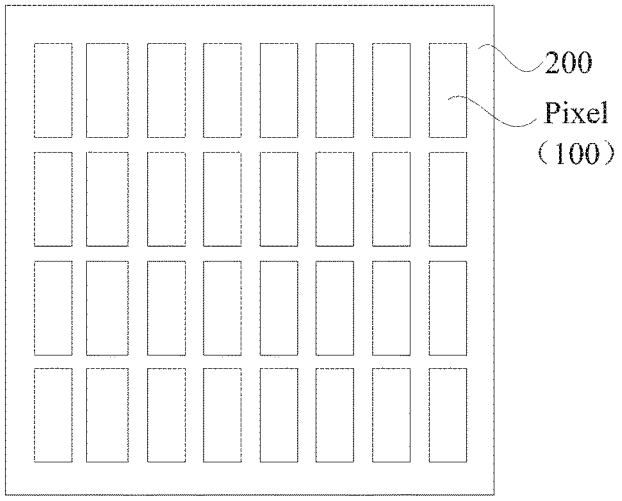
FIG. 12 is a schematic plan view of a display device, in accordance with some embodiments of the present disclosure.

Some embodiments of the present disclosure provide a display device. As shown in FIG. 12, the display device 200 includes a plurality of pixel circuits 100.

For example, the above display device 200 may be any product or component having a display function such as an OLED display, a digital photo frame, a mobile phone, a tablet computer and a navigator.

For example, the display device 200 provided by the embodiments of the present disclosure includes a plurality of pixels arranged in an array, and each pixel of the plurality of pixels includes the pixel circuit 100 according to any embodiment of the above embodiments. The display device 200 provided by the embodiments of the present disclosure has same beneficial effects as the pixel circuit 100 provided by the foregoing embodiments of the present disclosure. Since the pixel circuit 100 has been described in detail in the foregoing embodiments, details are not described herein again.

Figure 11:
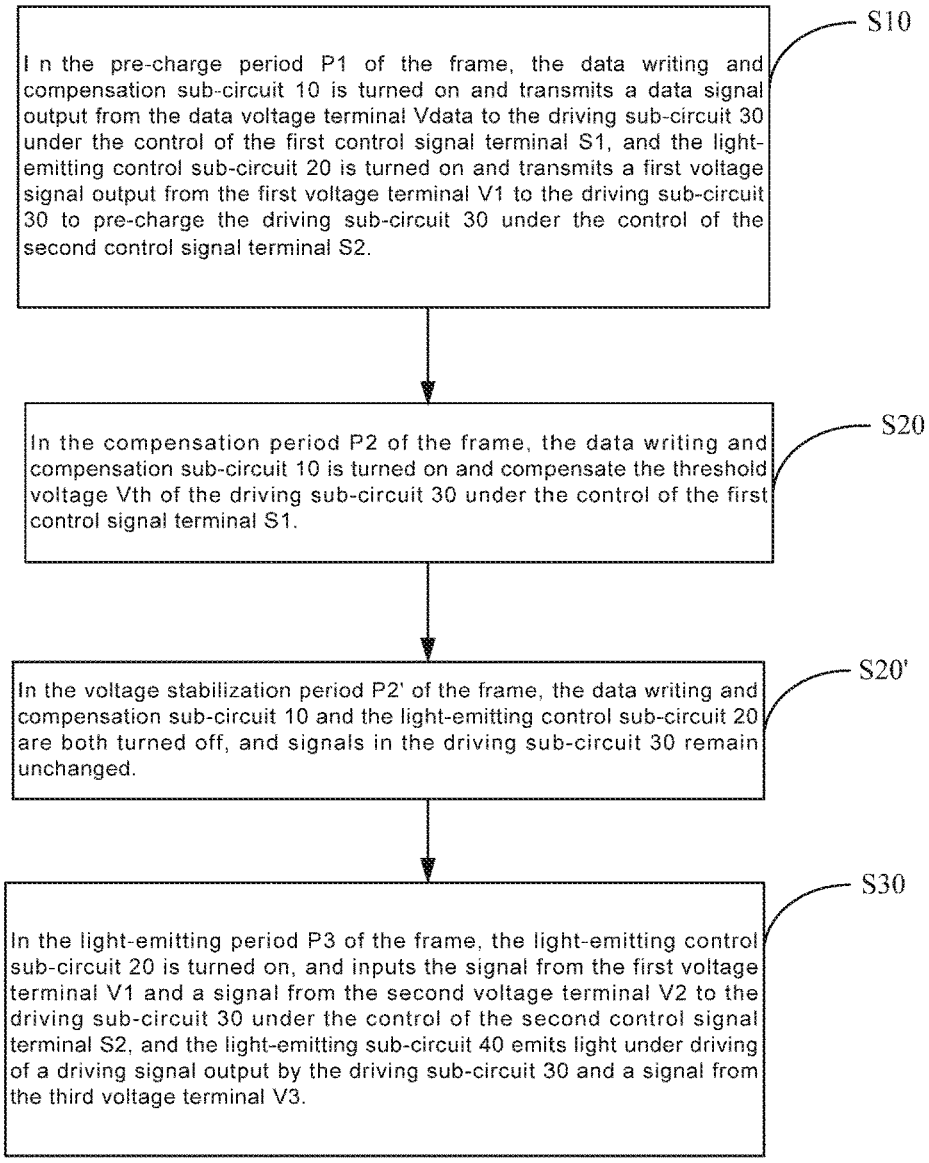
FIG. 11 is a flow diagram of a driving method of a pixel circuit, in accordance with some embodiments of the present disclosure.

Some embodiments of the present disclosure provide a driving method of the pixel circuit 100. The time of a frame sequentially includes the pre-charge period P1, the compensation period P2 and the light-emitting period P3. As shown in FIG. 11, the driving method includes the following steps.

In S10, in the pre-charge period P1 of the frame, the data writing and compensation sub-circuit 10 is turned on under the control of the first control signal terminal S1 and transmits a data signal from the data voltage terminal Vdata to the driving sub-circuit 30, and the light-emitting control sub-circuit 20 is turned on under the control of the second control signal terminal S2 and transmits a first voltage signal from the first voltage terminal V1 to the driving sub-circuit 30, to pre-charge the driving sub-circuit 30.

For example, with reference to FIGS. 4, 6*a* and 6*b*, in the pre-charge period P1 of the frame, a low level turn-on signal is input via the first control signal terminal S1 to control the first transistor T1 and the second transistor T2 to be turned on, and a high level turn-on signal is input via the second control signal terminal S2 to control the fourth transistor T4 and the fifth transistor T5 to be turned on, to pre-charge both ends (i.e., the first point O and the third point Q) of the storage capacitor C.

In some embodiments, with reference to FIG. 3, the data writing and compensation sub-circuit 10 is further electrically connected to the light-emitting sub-circuit 40. Thus, in the pre-charge period P1 of the frame, the data writing and compensation sub-circuit 10 is turned on under the control of the first control signal terminal S1, and may control the voltages at both ends of the light-emitting sub-circuit 40 to be equal while pre-charging the driving sub-circuit 30, so that the light-emitting sub-circuit 40 does not emit light in this period.

For example, with reference to FIGS. 5*a* and 5*b*, the data writing and compensation sub-circuit 10 further includes the third transistor T3 in addition to the first transistor T1 and the second transistor T2. The low level turn-on signal is input via the first control signal terminal S1 to control the first transistor T1 to be turned on to charge the first point O and simultaneously controls the third transistor T3 to be turned on, so that the voltages at the cathode and the anode of the light-emitting device D are equal, thereby preventing the light-emitting device D from emitting light.

In S20, in the compensation period P2 of the frame, the data writing and compensation sub-circuit 10 is turned on under the control of the first control signal terminal S1 and compensates the threshold voltage Vth of the driving sub-circuit 30.

For example, with reference to FIGS. 5*a* and 5*b*, the low level turn-on signal is input via the first control signal terminal S1 to control the first transistor T1, the second transistor T2 and the third transistor T3 to be turned on, a signal from the data voltage terminal Vdata is transmitted to the first point O through the first transistor T1, and the turning on of the second transistor T2 causes the gate $g_d$ of the driving transistor Td to be electrically connected to the first electrode $a_d$ of the driving transistor Td, thereby releasing the voltages at the third point Q and the fourth point W, and compensating the threshold voltage Vth of the driving sub-circuit 30.

In S30, in the light-emitting period P3 of the frame, the light-emitting control sub-circuit 20 is turned on under the control of the second control signal terminal S2, and transmits the first voltage signal from the first voltage terminal V1 and a second voltage signal from the second voltage terminal V2 to the driving sub-circuit 30, and the light-emitting sub-circuit 40 emits light under driving of a driving signal output by the driving sub-circuit 30 and a third voltage signal from the third voltage terminal V3.

For example, with reference to FIGS. 5*a* and 5*b*, the high level turn-on signal is input via the second control signal terminal S2 to control the fourth transistor T4 and the fifth transistor T5 to be turned on, the second voltage signal from the second voltage terminal V2 is transmitted to the first point O through the fifth transistor T5, and the bootstrap action of the storage capacitor C causes the third point to control the driving transistor Td to be turned on. The first voltage signal from the first voltage terminal V1 is transmitted to the driving transistor Td through the fourth transistor T4, and then is transmitted to the anode $d_1$ of the light-emitting device D through the driving transistor Td. The third voltage signal from the third voltage terminal V3 is transmitted to the cathode $d_2$ of the light-emitting device D. In this way, the light-emitting device D is driven to emit light.

In some embodiments, with reference to FIGS. 6*a* and 6*b*, the voltage stabilization period P2' is further included between the compensation period P2 and the light-emitting period P3, and the driving method of the pixel circuit 100 described above further includes the following steps.

In S20', in the voltage stabilization period P2' of the frame, the data writing and compensation sub-circuit 10 is turned off under the control of the first control signal terminal S1, and the light-emitting control sub-circuit 20 is also turned off under the control of the second control signal S2. Therefore, signals in the driving sub-circuit 30 remain unchanged.

For example, a high level turn-off signal is input via the first control signal terminal S1 and a low level turn-off signal is input via the second control signal terminal S2, so as to control the first transistor T1, the second transistor T2, the third transistor T3, the fourth transistor T4 and the fifth transistor T5 to be turned off, so that voltages at both ends of the storage capacitor C remain unchanged, that is, the voltages at the first point O and the third point Q are the same as those in the compensation period P2. Thus, the problem that the voltages at the first points O and the third points Q of some pixel circuits do not reach the set voltages (i.e., $V_O$=Vdata, and $V_Q$=Vth+VSS) due to the signal delay may be eliminated, thereby making a full preparation for the next light-emitting period P3.

Beneficial effects of the driving method of the pixel circuit provided by the embodiments of the present disclosure are the same as the beneficial effects of the pixel circuit 100 described above, which are not described herein again.

The foregoing descriptions are merely specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel circuit, comprising: a data writing and compensation sub-circuit, a driving sub-circuit, and a light-emitting control sub-circuit, wherein the data writing and compensation sub-circuit is electrically connected to the driving sub-circuit, a first control signal terminal and a data voltage terminal, and the data writing and compensation sub-circuit is configured to transmit a data signal from the data voltage terminal to the driving sub-circuit under control of the first control signal terminal, and to compensate a threshold voltage of the driving sub-circuit under the control of the first control signal terminal;

the light-emitting control sub-circuit is electrically connected to the driving sub-circuit, the data writing and compensation sub-circuit, a second control signal terminal, a first voltage terminal and a second voltage terminal, and the light-emitting control sub-circuit is configured to transmit a first voltage signal from the first voltage terminal to the driving sub-circuit and the data writing and compensation sub-circuit under control of the second control signal terminal, and to transmit a second voltage signal from the second voltage terminal to the driving sub-circuit under the control of the second control signal terminal; and the driving sub-circuit is further electrically connected to a light-emitting sub-circuit, and the driving sub-circuit is configured to transmit a signal output from the light-emitting control sub-circuit to the light-emitting sub-circuit;

wherein transistors in the data writing and compensation sub-circuit are P-type transistors, and transistors in the light-emitting control sub-circuit are N-type transistors; or the transistors in the data writing and compensation sub-circuit are N-type transistors, and the transistors in the light-emitting control sub-circuit are P-type transistors.

2. The pixel circuit according to claim 1, wherein the data writing and compensation sub-circuit includes:

a first transistor, wherein a gate of the first transistor is electrically connected to the first control signal terminal, a first electrode of the first transistor is electrically connected to the data voltage terminal, and a second electrode of the first transistor is electrically connected to the driving sub-circuit; and a second transistor, wherein a gate of the second transistor is electrically connected to the first control signal terminal, a first electrode of the second transistor is electrically connected to the driving sub-circuit, and a second electrode of the second transistor is electrically connected to the light-emitting control sub-circuit.

3. The pixel circuit according to claim 1, wherein the data writing and compensation sub-circuit is further electrically connected to the light-emitting sub-circuit, and the data writing and compensation sub-circuit is configured to make voltages at both ends of the light-emitting sub-circuit equal under the control of the first control signal terminal.

4. The pixel circuit according to claim 3, wherein the data writing and compensation sub-circuit includes:

a first transistor, wherein a gate of the first transistor is electrically connected to the first control signal terminal, a first electrode of the first transistor is electrically connected to the data voltage terminal, and a second electrode of the first transistor is electrically connected to the driving sub-circuit;

a second transistor, wherein a gate of the second transistor is electrically connected to the first control signal terminal, a first electrode of the second transistor is electrically connected to the driving sub-circuit, and a second electrode of the second transistor is electrically connected to the light-emitting control sub-circuit; and a third transistor, wherein a gate of the third transistor is electrically connected to the first control signal terminal, a first electrode of the third transistor is electrically connected to the driving sub-circuit, and a second electrode of the third transistor is electrically connected to the light-emitting sub-circuit and the third voltage terminal.

5. The pixel circuit according to claim 1, wherein the driving sub-circuit includes:

a storage capacitor, wherein a first end of the storage capacitor is electrically connected to the data writing and compensation sub-circuit and the light-emitting control sub-circuit; and a driving transistor, wherein a gate of the driving transistor is electrically connected to a second end of the storage capacitor and the data writing and compensation sub-circuit, a first electrode of the driving transistor is electrically connected to the data writing and compensation sub-circuit and the light-emitting control sub-circuit, and a second electrode of the driving transistor is electrically connected to the light-emitting sub-circuit.

6. The pixel circuit according to claim 1, wherein the light-emitting control sub-circuit includes:

a fourth transistor, wherein a gate of the fourth transistor is electrically connected to the second control signal terminal, a first electrode of the fourth transistor is electrically connected to the first voltage terminal, and a second electrode of the fourth transistor is electrically connected to the data writing and compensation sub-circuit and the driving sub-circuit; and a fifth transistor, wherein a gate of the fifth transistor is electrically connected to the second control signal terminal, a first electrode of the fifth transistor is electrically connected to the data writing and compensation sub-circuit and the driving sub-circuit, and a second electrode of the fifth transistor is electrically connected to the second voltage terminal.

7. The pixel circuit according to claim 1, wherein the data writing and compensation sub-circuit includes:

a first transistor, wherein a gate of the first transistor is electrically connected to the first control signal terminal, and a first electrode of the first transistor is electrically connected to the data voltage terminal; and a second transistor, wherein a gate of the second transistor is electrically connected to the first control signal terminal;

the driving sub-circuit includes:

a storage capacitor, wherein a first end of the storage capacitor is electrically connected to a second electrode of the first transistor, and a second end of the storage capacitor is electrically connected to a first electrode of the second transistor; and a driving transistor, wherein a gate of the driving transistor is electrically connected to the first electrode of the second transistor and the second end of the storage capacitor, and a first electrode of the driving transistor is electrically connected to a second electrode of the second transistor;

the light-emitting control sub-circuit includes:

a fourth transistor, wherein a gate of the fourth transistor is electrically connected to the second control signal terminal, a first electrode of the fourth transistor is electrically connected to the first voltage terminal, and a second electrode of the fourth transistor is electrically connected to the second electrode of the second transistor and the first electrode of the driving transistor; and a fifth transistor, wherein a gate of the fifth transistor is electrically connected to the second control signal terminal, a first electrode of the fifth transistor is electrically connected to the second electrode of the first transistor and the first end of the storage capacitor, and a second electrode of the fifth transistor is electrically connected to the second voltage terminal.

8. The pixel circuit according to claim 7, further comprising the light-emitting sub-circuit, wherein the light-emitting sub-circuit is further electrically connected to a third voltage terminal, and the light-emitting sub-circuit is configured to emit light under driving of a signal input from the driving sub-circuit and a third voltage signal from the third voltage terminal.

9. The pixel circuit according to claim 8, wherein the light-emitting sub-circuit includes a light-emitting device, an anode of the light-emitting device is electrically connected to a second electrode of the driving transistor, and a cathode of the light-emitting device is electrically connected to the third voltage terminal.

10. The pixel circuit according to claim 9, wherein the data writing and compensation sub-circuit further includes a third transistor, wherein a gate of the third transistor is electrically connected to the first control signal terminal, a first electrode of the third transistor is electrically connected to the second electrode of the driving transistor and the anode of the light-emitting device, and a second electrode of the third transistor is electrically connected to the third voltage terminal and the cathode of the light-emitting device.

11. A display device, comprising at least one pixel circuit according to claim 1.

12. The pixel circuit according to claim 1, further comprising the light-emitting sub-circuit, wherein the light-emitting sub-circuit is further electrically connected to a third voltage terminal, and the light-emitting sub-circuit is configured to emit light under driving of a signal input from the driving sub-circuit and a third voltage signal from the third voltage terminal.

13. A driving method of a pixel circuit, configured to drive the pixel circuit according to claim 12, the driving method comprising: time of a frame sequentially including a pre-charge period, a compensation period and a light-emitting period;

in the pre-charge period, turning on the data writing and compensation sub-circuit under control of the first control signal terminal, and transmitting, by the data writing and compensation sub-circuit, a data signal from the data voltage terminal to the driving sub-circuit, and turning on the light-emitting control sub-circuit under control of the second control signal terminal, and transmitting, by the light-emitting control sub-circuit, a first voltage signal from the first voltage terminal to the driving sub-circuit, to pre-charge the driving sub-circuit;

in the compensation period, turning on the data writing and compensation sub-circuit under the control of the first control signal terminal, and compensating, by the data writing and compensation sub-circuit, a threshold voltage of the driving sub-circuit; and in the light-emitting period, turning on the light-emitting control sub-circuit under the control of the second control signal terminal, and transmitting, by the light-emitting control sub-circuit, the first voltage signal from the first voltage terminal and a second voltage signal from the second voltage terminal to the driving sub-circuit, and emitting, by the light-emitting sub-circuit, light under driving of a driving signal output by the driving sub-circuit and a third voltage signal from the third voltage terminal.

14. The driving method according to claim 13, wherein the time of the frame further includes a voltage stabilization period between the compensation period and the light-emitting period, and the driving method further comprises:

in the voltage stabilization period:

turning off the data writing and compensation sub-circuit under the control of the first control signal terminal, turning off the lighting-emitting control sub-circuit under the control of the second control signal terminal, so that signals in the driving sub-circuit remain unchanged.

15. The driving method according to claim 13, wherein the data writing and compensation sub-circuit is further electrically connected to the light-emitting sub-circuit, and the driving method further comprises:

in the pre-charge period:

turning on the data writing and compensation sub-circuit under the control of the first control signal terminal, and controlling voltages at both ends of the light-emitting sub-circuit to be equal while pre-charging the driving sub-circuit.

* * * * *